US006219370B1

(12) United States Patent
Wurtz

(10) Patent No.: US 6,219,370 B1
(45) Date of Patent: Apr. 17, 2001

(54) CHANNEL ARRANGEMENT

(75) Inventor: Paul-Antoine Wurtz, Moers (DE)

(73) Assignee: GfT Gesellschaft für Feuerfest-Technik m.b.H., Moers (DE)

( * ) Notice: Subject to any disclaimer, the term of this patent is extended or adjusted under 35 U.S.C. 154(b) by 0 days.

(21) Appl. No.: 09/491,612

(22) Filed: Jan. 26, 2000

(30) Foreign Application Priority Data

Dec. 21, 1999 (DE) ..... 299 22 336

(51) Int. Cl.[7] ..... H05B 3/60

(52) U.S. Cl. ..... 373/42; 373/45; 373/83; 373/115; 266/45

(58) Field of Search ..... 373/42, 43, 44, 373/45, 71, 72, 79, 83, 84, 115, 142, 161, 162; 266/44, 45, 46, 232, 242

(56) References Cited

U.S. PATENT DOCUMENTS 3,735,010 * 5/1973 Turpin ..... 373/45
3,973,076 * 8/1976 Scott, Jr. et al. ..... 373/45
5,968,447 * 10/1999 Pavlicevic et al. ..... 266/45
6,090,340 * 7/2000 Boonacker et al. ..... 266/46

* cited by examiner

*Primary Examiner*—Tu Ba Hoang
(74) *Attorney, Agent, or Firm*—Henry M. Feiereisen

(57) ABSTRACT

A channel arrangement for discharging molten metal from a smelting furnace, includes a channel (2) with two sidewalls (4, 5) and a channel bottom (6) made of a fireproof material. The channel (2) is arranged within a formwork trough (3) having receiving spaces (14) abutting lateral formwork walls (12, 13). A respective transversely moveable push wall (7, 8) is associated with each of the formwork walls (12, 13), while the receiving space (14) can be filled with a fireproof material, thereby providing a replacement sidewall. As soon as a channel (2) is worn, the channel is taken out of service and the bottom region is exposed. The remaining portion of the sidewalls (4, 5) together with the replacement sidewalls positioned in the receiving space (14) is displaced by a predetermined distance, and subsequently a fireproof material is poured into the channel bottom (6) as well as into the new receiving space (14) created behind the replacement sidewalls.

4 Claims, 2 Drawing Sheets

CHANNEL ARRANGEMENT

BACKGROUND OF THE INVENTION

The invention relates to a channel arrangement for discharging molten metal from a smelting furnace.

Discharging molten metal from a smelting furnace, such as a blast furnace or a cupola furnace, is referred to by the technical term "tapping". The liquid metal together with the liquid running slag is guided from the smelting furnace through a channel made of fireproof material. The channel is disposed in a thick lining made of refractory clay brick which is generally referred to as "lining".

The high thermal and mechanical stress caused by the annealing liquid material which is conducted through the channel during the tapping, severely stresses the inner surfaces of the channel. This causes increased wear in the so-called slag zone in the upper region of the channel as well as in the so-called pig-iron zone in the lower region. Hence, the channel has to be replaced according to the severity of the erosion, typically in regular intervals when the sidewalls are eroded by about one half of their thickness.

The channel is then taken out of service and repaired. With conventional methods, the worn-out regions are broken away. This can be done partly with machines, partly manually using jackhammers. Thereafter, the channel is from-stripped from inside and the region to be repaired is filled with a pourable compound of a fireproof material.

Several days, including the time required for the pourable compound to dry, have to be set aside before the furnace can be tapped again. Repairing the channel and removing the material from the channel is labor-intensive and time-consuming. Accordingly, the costs associated with the conventional methods tend to be quite high.

SUMMARY OF THE INVENTION

It is therefore an object of the invention to provide—based on the state of art—a channel arrangement for discharging molten metal from a smelting furnace which significantly reduces the time required to rebuild the worn-out channel, thereby reducing the overall cost.

The object is solved by a channel arrangement which includes a channel with two sidewalls and a channel bottom made of a fireproof material, and is arranged inside a formwork trough. The lateral formwork walls are provided with a transversely moveable push wall. A receiving space which can be filled with a hardenable fireproof material is provided between the formwork walls and the sidewalls.

By employing the channel arrangement according to the invention, the process of reconditioning the channel can be significantly simplified. According to one aspect of the invention, the replacement sidewalls are held in reserve behind the sidewalls of an operational channel. The replacement sidewalls are created by filling the receiving space with the fireproof material, in order to exploit hereby the operational channel and the sidewalls of the channel as form.

The steps associated with this process can be described as follows:

In the initial state, a first channel is poured in a conventional manner. The push walls form here the lateral formwork. After the channel has hardened, the push walls are moved away from the sidewalls of the channel towards the lateral formwork walls of the formwork trough. The receiving space which is thereby formed between the push walls and the sidewalls of the channel can subsequently be filled with a fireproof material.

As soon as the channel in operation is so severely worn out as to require a replacement, the channel is taken out of service and cleaned by stripping the bottom portion. The remaining sections of the sidewalls together with the replacement sidewalls located in the receiving space are then moved forwardly by a predetermined distance. The bottom of the channel is then filled with fireproof material, as is the receiving space produced behind the replacement sidewalls.

The fireproof material can be, for example, poured high-temperature concrete, pourable thixotropic material, low and ultra-low cement concrete, as well as tamping material and injection material. Dry compounds and so-called back-fill materials can also be used.

The channel arrangement according to the invention saves significant time and effort, while at the same time requiring much less fireproof material, since the already worn material remains in the aggregate and functions as a formwork for the newly formed or repaired lining. This aspect also results in significantly lower costs.

Since less pourable material is required, the disposal costs can also be reduced.

According to an advantageous embodiment of the channel arrangement of the invention, the channel is arranged on a base plate inside the formwork trough. With this arrangement, the region of the sidewalls facing the base can be more easily cleared, and the replacement sidewalls can be more easily moved on the base plate.

According to another feature of the invention an adjustment mechanism can be used to move the push walls. Different systems can be implemented. For example, the system can be implemented using a cylinder and cylinder rods or threaded adjustment spindles.

According to yet another feature of the invention the inner surfaces of the formwork trough are provided with an insulating lining. In practice, an insulation made of, for example, refractory clay bricks can be arranged underneath the base plate.

BRIEF DESCRIPTION OF THE DRAWINGS

The invention will be described hereinafter with reference to an embodiment illustrated in the drawing, in which.

DETAILED DESCRIPTION OF PREFERRED EMBODIMENTS

Figure 1:
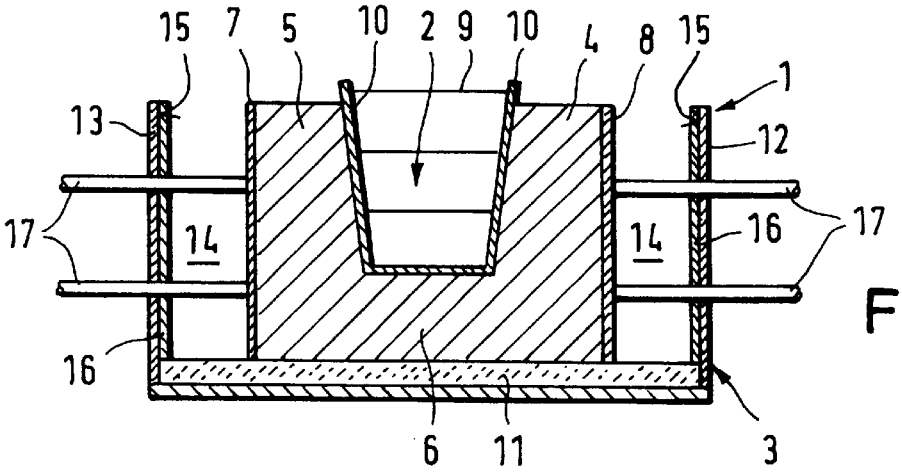
FIG. 1 is a vertical cross-section of a channel arrangement for a conventional pouring process.

FIG. 1 shows a channel arrangement 1 for discharging molten metal from a smelting furnace (not shown). A center region of the channel arrangement 1 includes a channel 2 poured from a fireproof material, wherein the channel 2 is arranged inside a formwork trough 3 made of steel. When the channel 2 is poured, the two sidewalls 4, 5 as well as a channel bottom 6 are formed. Moveable push walls 7, 8 form here the lateral shuttering for the sidewalls 4, 5, wherein a form body 9 having side members 10, which are inclined with respect to the vertical, is arranged in the upper region between the push walls 7, 8 and provides the necessary contour of channel 2. The channel 2 is supported on a fireproof base plate 11 which is disposed inside the formwork trough 3.

The transverse dimension of the formwork trough 3 is greater than the channel 2, and a receiving space 14 is provided between the sidewalls 4, 5 of the channel 2 and the lateral formwork walls 12, 13 of the formwork trough 3. In addition, the inner surfaces 15 of the formwork trough 3 facing the channel 2 are provided with an insulating lining 16. Although not shown here, but useful in practical applications, is the provision of an additional insulating lining made, for example, of refractory clay bricks underneath the base plate 11.

Figure 2:
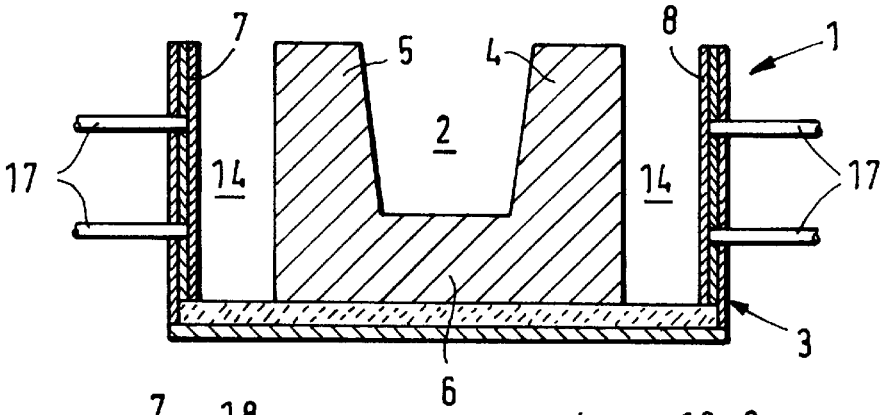
FIGS. 2 and 3 is an illustration according to FIG. 1, depicting the pouring of a fireproof material into the lateral receiving spaces.
Figure 3:
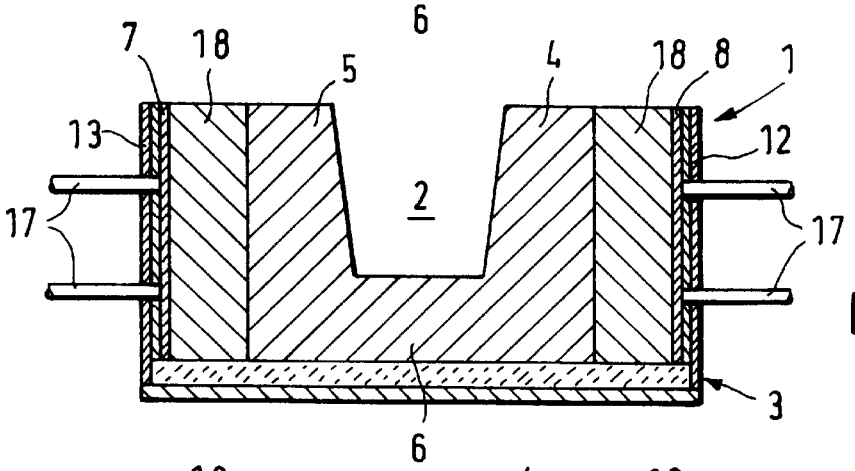
Figure 4:
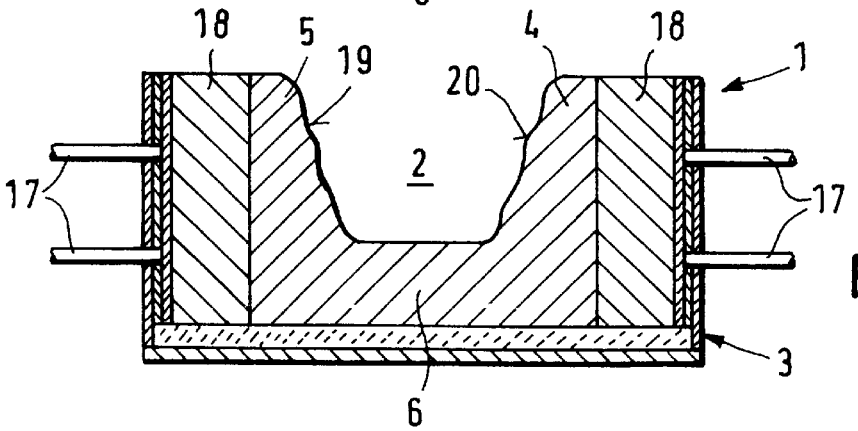
FIG. 4 is an illustration according to FIG. 3, depicting the progressive erosion of the channel.

After the channel 2 has hardened, an adjustment mechanism 17, which penetrates through the formwork walls 12, 13, moves the push walls 7, 8 outwardly towards the formwork walls 12, 13 (FIG. 2). The receiving space 14, which is thereby formed between the push walls 7, 8 and the sidewalls 4, 5 of the channel 2, is also filled with a fireproof material 18 (FIG. 3).

Figure 5:
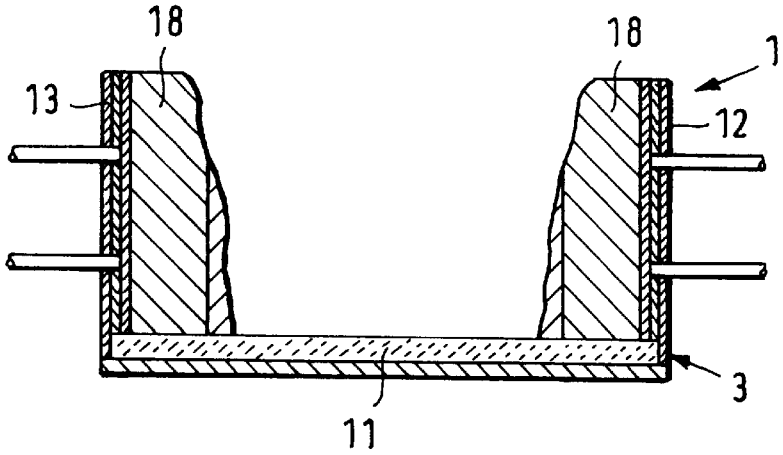
FIG. 5 shows the channel arrangement after the bottom of the channel is broken away.
Figure 6:
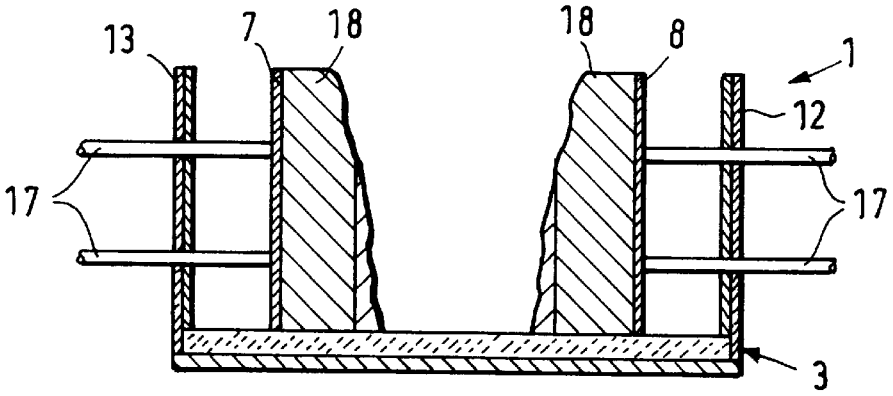
FIG. 6 shows a displacement of the replacement sidewalls towards the center of the channel.

When the molten material is discharged from the smelting furnace, the inner surfaces 19, 20 of the channel 2 are subject to severe erosion, which can cause a complete wear of the sidewalls 4, 5. When the channel 2 is worn off to a point where it has to be reconditioned, the channel 2 is first taken out of service and the center regions of the channel 2 are exposed (FIG. 5). In a subsequent step, the push walls 7, 8 and the fireproof material 18, previously located in the receiving space 14, are moved toward the center of the formwork trough 3 (FIG. 6). In the new position, the fireproof material 18 acts as a replacement sidewall 21, 22.

Figure 7:
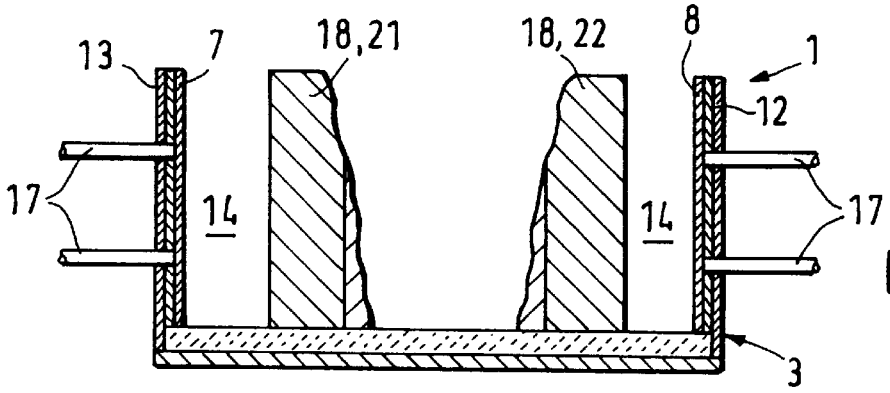
FIGS. 7 and 8 show the displacement of the push walls towards the formwork walls and subsequent pouring of the channel bottom and the exposed receiving spaces.
Figure 8:
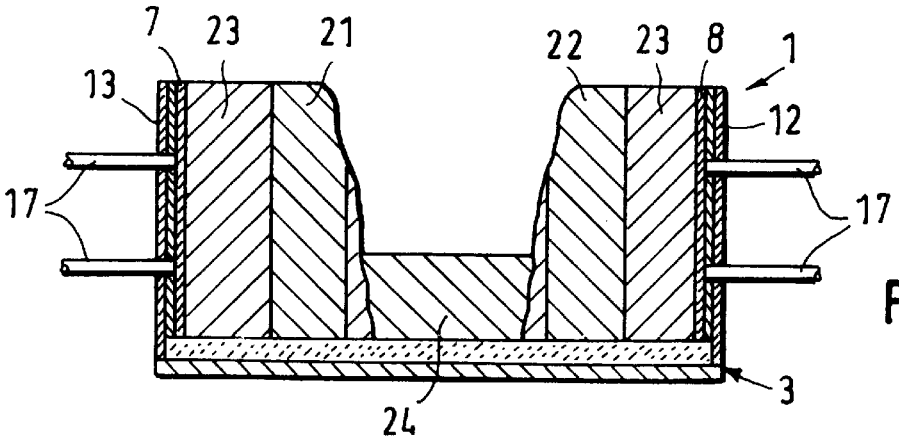

After the push walls 7, 8 are retracted to the formwork walls 12, 13 (FIG. 7), the receiving space 14 is cleared again and fireproof material 23 can again be poured into the receiving space 14. At the same time, a new channel bottom 24 is poured, which can be done without a form body 9 as a consequence of the presence of the replacement sidewalls 21, 22 (FIG. 8).

What is claimed is:

1. A channel arrangement for discharging molten metal from a smelting furnace, comprising:

a channel having two side walls and a channel bottom, said sidewalls and said channel bottom being made of a fire proof material;

a formwork trough receiving the channel and having lateral formwork walls and receiving spaces abutting the formwork walls; and transversely moveable push walls, each of the push walls, being associated to a corresponding one of the formwork walls whereby the push walls and the formwork walls are placed into one-to-me correspondence, wherein the receiving spaces are destined for being filled with a fire proof material.

2. The channel arrangement according to claim 1, wherein the formwork trough has a base plate, said channel being arranged inside the formwork trough on base plate.

3. The channel arrangement according to claim 1, and further comprising and adjustment mechanism for moving the push walls.

4. The channel arrangement according to claim 1, wherein the form work trough has inner surfaces, and further comprising an insulating lining for lining the inner surfaces.

* * * * *